US005364181A

United States Patent [19]

Scheible

[11] Patent Number: 5,364,181

[45] Date of Patent: Nov. 15, 1994

[54] FRONT ADJUSTMENT FOR A PANEL WITH SNAP-ON MECHANISM FOR A DRAWER

[75] Inventor: Adolf Scheible, Lauterach, Austria

[73] Assignee: Grass AG, Hochst/Vlbg., Austria

[21] Appl. No.: 134,058

[22] Filed: Oct. 12, 1993

[30] Foreign Application Priority Data

Oct. 12, 1992 [DE] Germany ..... 9213683[U]

[51] Int. Cl.[5] ..... A47B 95/00

[52] U.S. Cl. ..... 312/348.4

[58] Field of Search ..... 312/348.4, 330.1

[56] References Cited

U.S. PATENT DOCUMENTS 5,002,346 3/1991 Gasser ..... 312/348.4

FOREIGN PATENT DOCUMENTS 3120555 6/1982 Germany ..... 312/348.4

3801103 8/1988 Germany ..... 312/348.4

*Primary Examiner*—Kenneth J. Dorner

*Assistant Examiner*—Gerald A. Anderson

[57] ABSTRACT

A front adjustment of a front panel with snap-on mechanism for a drawer is described; whereby, the front panel is connected to a fastening mechanism and is designed for height adjustment, as well as lateral adjustment. In order to adjust the front panel in the horizontal and vertical directions with the largely hidden adjustable mechanism system, it is presented, that the front panel is on the back side of the snap-on hanger, that is connected to respective adjustable components; whereby, the adjustable component is situated in the glide profile.

4 Claims, 3 Drawing Sheets

FRONT ADJUSTMENT FOR A PANEL WITH SNAP-ON MECHANISM FOR A DRAWER

BACKGROUND OF THE INVENTION

1. Field of the Invention

The innovation relates to the matter of a drawer which has a front panel with a snap-on mechanism and has front adjustment capabilities according to principal concept of protection claim 1.

The purpose of the innovation is: a front panel ideally in two perpendicular to each other in upright positions; that is, the height alignment and the side alignment can be adjusted without the adjustment mechanism being visible.

The newer drawers will use the so-called integrated concealed slides. The integrated concealed slides are the side walls that are inserted into hollow chamber profiles on which adjustable front panels can be attached.

2. Description of the Prior Art

The previously known front adjustment systems, however, had the disadvantage that the front adjustment, from without, was visible behind the front panel when the drawer was open.

Moreover, the connection between the front panel and the associated fitting was not quickly removed, but, on the contrary, was releasable only with relatively great assembly difficulty.

The innovation is, therefore, based on the further development of the front adjustment mentioned in the above descriptions, so that hidden front fitting system on the concealed slides can be utilized and connected to a drawer front panel which can be quickly detached.

SUMMARY OF THE INVENTION

The purpose of this innovation is explained by the technical information in claim 1.

An important feature of the innovation is that the back side of the front panel is fastened to a snap-on hanger which is above a snap-on hanger and below a detachable fastener, which with a drawer side wall forms a front fastening system.

The innovative fitting system results in a quick and simple fastening of the front panel to the drawer, because a corresponding hook on an attached tab of the adjustable component is fastened on the backside of the front panel snap-on hanger system. Under this snap-on hanger is an easily detachable release hook which can be connected with the before mentioned adjustable part.

The before mentioned release consists rather of a resilient pawl, that can be hanged with an attached catch nozzle in a notch on the snap-on hanger and is there braced and fastened with the snap-on hanger.

The release on the drawer with a pawl can also be significant in that the pawl extends back from the front panel and thereby, the upper half of the nozzle at the pivot of the nozzle also slants to the back. The front panel will be engaged with the snap-on hangers of the pawls, respectively, the nozzles, which swing out of the way, lead to the back: whereby, a notch of the snap-on hanger releases with the pawl and whereby. simultaneously, the hook of the upper side of the snap-on hanger latches with the upper side of the adjustment component.

This pawl design, in which the nozzle slants down and back, offers an advantage that at the upper half of the nozzle pivot system, the front panel will be pressed down and thereby, guarantees the automatic snap-on of the front panel.

The notch, in which the catch nozzle engages, has such dimensions that allow the front panels together with the snap-on hangers to be adjusted according to height and side. The panels, together with the snap-on hangers are situated in two parts, each perpendicular to the other.

The adjustment screw is loosened in order to adjust the height; whereby, the drawer side wall can be adjusted in the elongated hole, which is aligned in a vertical direction.

In order to adjust the side, the resilient pawl is removed from the non positive engagement with the notch in the area of the snap-on hangers, and the panel can be slid out in the area of the length of the notch (horizontal length). Whereby, after a corresponding shifting, the pawl will be engaged again.

It is self-explanatory that the innovation's feature front fitting is available to both side walls of the drawer. However, for simplification, a single front fitting will be more closely described in the following information.

The invention basis of the submitted innovation results from not only the matter of the particulars of the protection claims, but also the various combinations of the individual protection claims.

All records, documents and evidence, inclusive of the summary, open and disclosed statements and declarations and indications and features, especially those represented embodiments in the drawings, will be claimed as fundamental and significant inventions, as far as the claims individually or in combinations are relative to the position that the technology is new.

The innovation at hand will be explained more precisely by the various explanations shown by the following representational designs. Hereby, additional significant features and advantages of the innovation will be concluded from the designs and their descriptions.

DESCRIPTION OF THE PREFERRED EMBODIMENT

Figure 1:
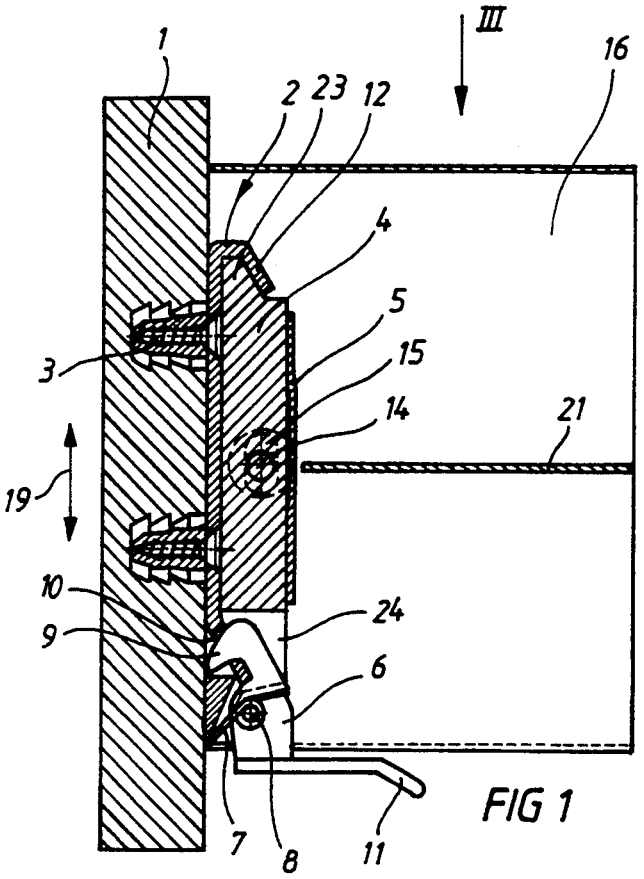
FIG. 1: Section according to line I—I through a front fitting as regards the innovation.

The backside of front panel (1) is connected, respectively, to a snap-on hanger (2) with help from screws (3); that inserts the breadth so that the snap-on hanger (2) is somewhat smaller than the open inner profile of the side wall (16), that is formed as integrated concealed slides.

The side wall (16) consists fundamentally of a V-edge (roof) shaped profile, which is reinforced in the middle by a U-shaped smaller profile. This consists fundamentally of a exterior vertical support connection (22), a horizontal support connection (21) and an inner vertical support connection (22).

On the inner side of the drawer side itself, a drawer bottom is retained.

The side wall 16 forms an inner vertical support connection (18), in which an elongated hole (15) is worked in with vertical length extension.

Figure 3:
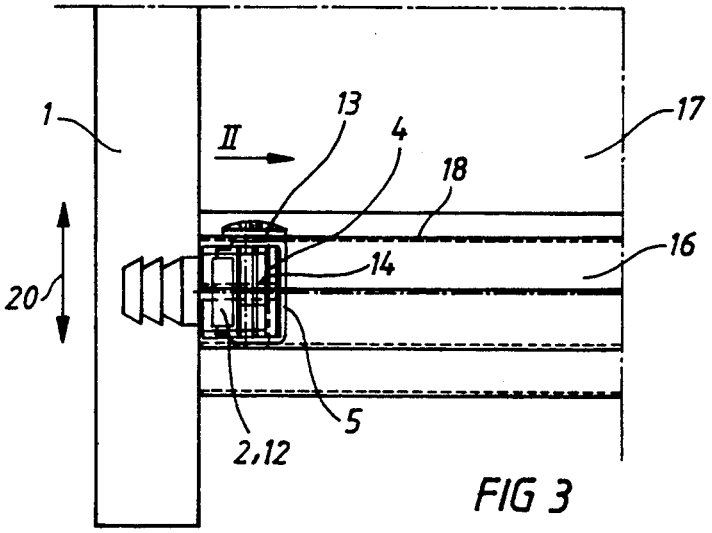
FIG. 3: Plan view in arrow direction III in FIG. 1.
Figure 5:
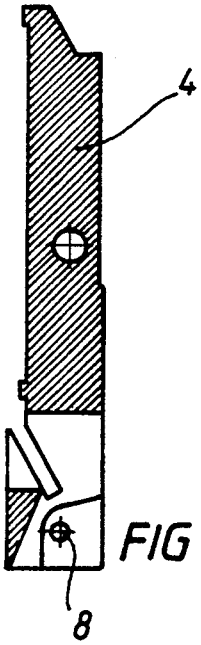
FIG. 5: Section of adjustable component.
Figure 6:
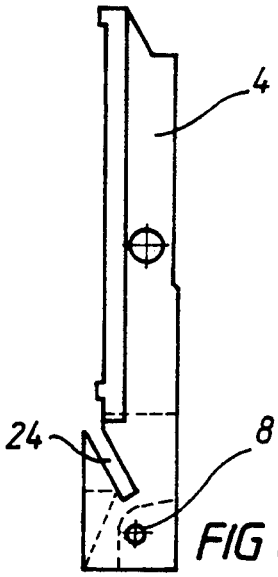
FIG. 6: Side view of the adjustable component.
Figure 4:
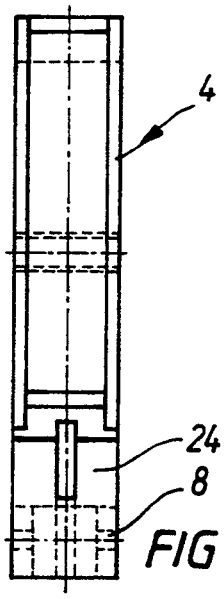
FIG. 4: Front view of adjustable component.
Figure 7:
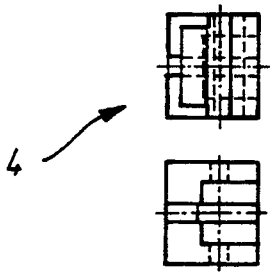
FIG. 7: Plan view of the adjustable component.
Figure 10:
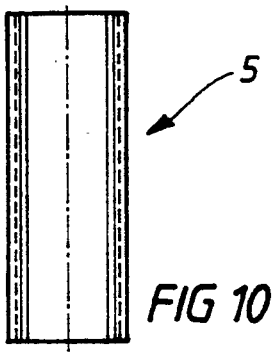
FIG. 10: Front view of the glide.
Figure 8:
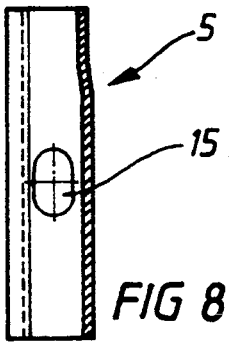
FIG. 8: A section through the glide profile.
Figure 11:
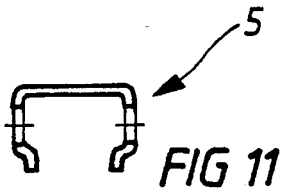
FIG. 11: The plan view of the glide profile according to FIG. 1.
Figure 9:
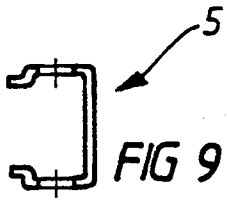
FIG. 9: Plan view of the glide profile.

The adjustment part (4) is fundamentally and significantly formed somewhat as C-shaped profile according to FIGS. 4 though 7, which is accommodated in the open inner space of the likewise c-shaped profiled glide profile 5. (FIG. 3)

The glide profile (5) as in FIGS. 8–11 is likewise designed somewhat as C-shaped profile and both profiles engage one another; whereby, the glide profile 5 engages the adjustment component 4 and both parts 4,5 are shifted relative to each other in the vertical direction.

The glide profile (5) is firmly fixed with the side wall with a support connection so that these together form one component.

To fasten the front panel (1) to the innovative-related front fitting, the snap-on hanger is hung with the upper hook (12) on an attached tab (23) of the adjustment component.

Simultaneously, in the bottom area of the adjustable components (4), a slot (24) is provided in which a pawl (6) is situated where it can be turned. The pawl (6) is located in a pivot (8) over a twistable pin and is harnessed resilient over a spring (7) in a closed position.

The pawl (6) inserts a bottom lever (11 ) so that it can be turned. The lever (11 ) is not visible and is activated from beneath behind the front panel, to the side and under half of the bottom (17).

Thereby, the pawl (6) inserts a catch nozzle, that in an attached notch (19) in the area of the snap-on hangers (2) is braced.

Figure 2:
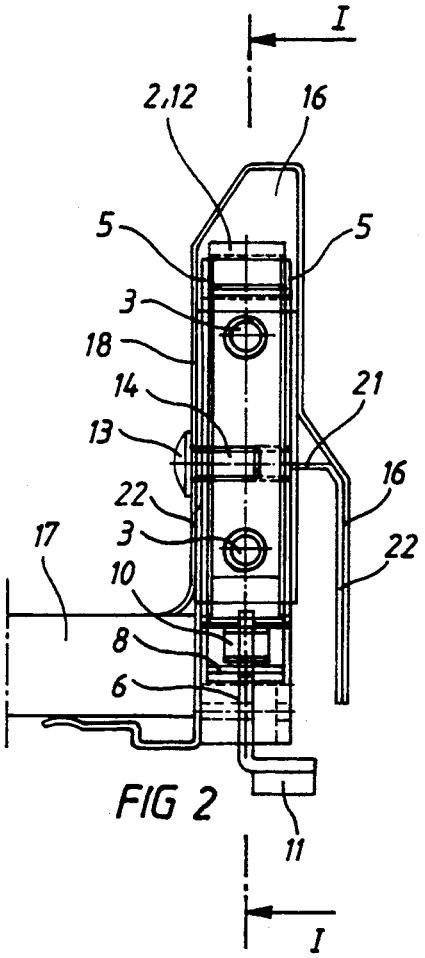
FIG. 2: Front view of the adjustment fittings in arrow direction II in FIG. 3 detached front panel.

The notch (10) inserts a certain width (FIG. 2), so that a side adjustment is possible in the arrow direction (20); whereby, the catch nozzle (9) in the area of the notch (10) can be shifted in the arrow direction (20).

A screw bore hole is worked into the adjustment component (4), in which the bolt (14) engages an adjustment screw (13).

The adjustable screws (13) engages with its bolt (14) through an elongated hole (15) in the support connection (18) of the side wall (16) and through an same type of aligned systematic elongated hole (15) throughout the range of the glide profile (5).

The glide profile (5), which is firmly fixed to the side wall (16), is adjustable systematically to the adjustment part (4).

By loosening the adjustable screw (13), the adjustable component (4) can be shifted into both elongated holes (15), which are aligned behind each other (height adjustment in arrow direction (19)), and when tightened, can adjust the height position of the adjustable parts (4) in relation to the snap-on hanger (2).

In another, not closely described embodiment, the adjustable eccentric can be utilized instead of the adjustable screw (13). The adjustable eccentric is reinforced with its part of the adjustable component and with its eccentric part of a notch in the area of a glide profile.

The pawl over the lever (11) does not have to be utilized for the purpose of height adjustment in the arrow direction (19) when the adjustment screws (13) are loosened. That is, the height adjustment results independently from the side adjustment.

The inverse also holds true that the side adjustment in the arrow direction (20) can be undertaken independently from the height adjustment (19).

To make the side adjustment simpler, the pawl (6) with its catch nozzle (9) can be released from its non positive tension in the notch; whereby, it stays engaged with this notch, in order that the front panel can be laterally adjusted in the arrow direction (20).

With the described adjustment, it is also possible to adjust the height (arrow direction (19)) of both drawer sides independently from each other, so that the gradient of the front panel can be regulated in a horizontal direction.

Important with the innovation-related front fitting is also, that this fully admits the side wall (16) in the profile and is not visible from any side. Therefore, from the drawer's inner side, only the adjustable screw (13) is visible and from the bottom of the drawer only the lever (11 ) of the pawl (6) is visible.

Figure 12:
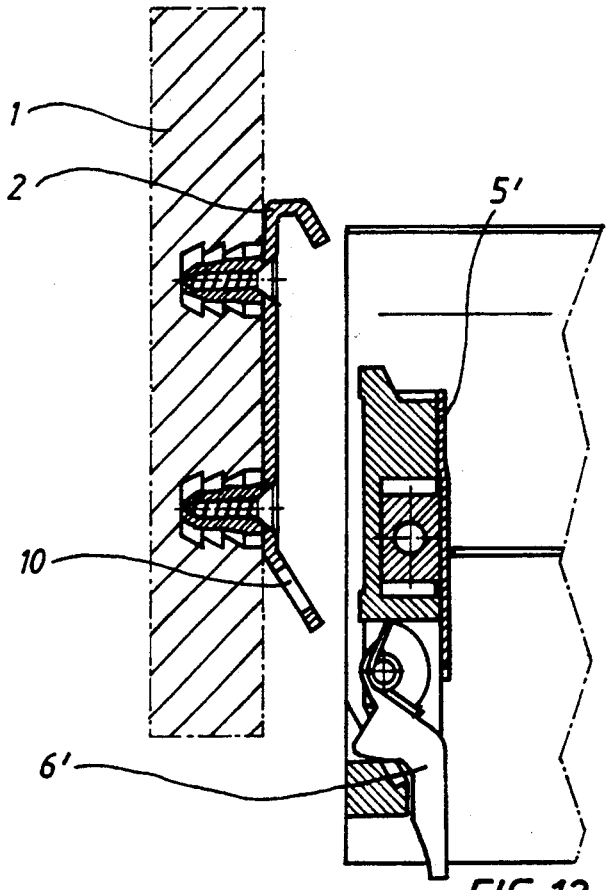
FIG. 12: An embodiment of a release with representation of a snap-on hanger in a position from of the catch nozzle; whereby, the catch nozzle slants to the bottom and back.

In FIG. 12 the snap-on hanger (2) is presented in the location in front of pawl (6'); whereby, the pawl (6') inserts a pivot in the upper half of the bottom to back slanted catch nozzle. The pawl (6') is hereby presented in connection with the glide profile (5'). Leading out from the side walls, that have not been closely described here, an eccentric adjustment is, according to FIGS. 12 to 15 represented.

Figure 13:
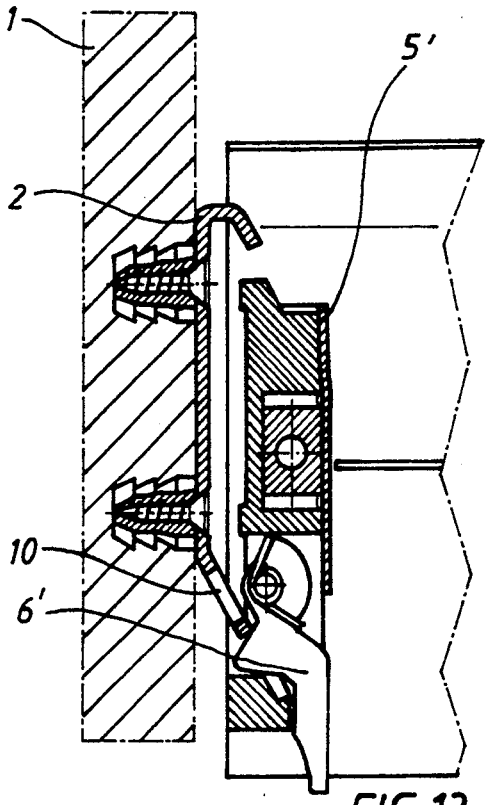
FIG. 13: The snap-on hanger at the closing of the catch nozzle.

The snap-on hanger (2) in FIG. 13 is already pressed down on the drawer and the notch (10) reaches in the area of pawl (6'); whereby, the snap-on hanger (2) with its lowest side is (further represented in figure (14)) the catch nozzle of the pawl (6') sloped to the bottom and back.

Figure 14:
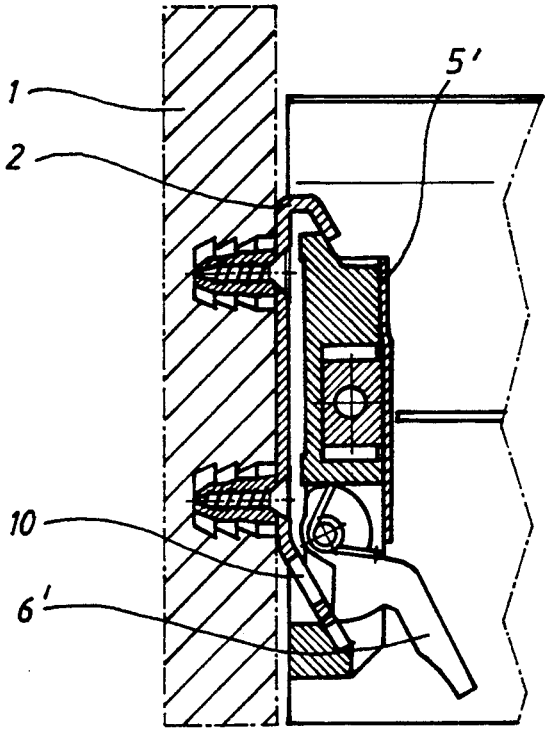
FIG. 14: A snap-on hanger at the back of "pressed away" catch nozzle.
Figure 15:
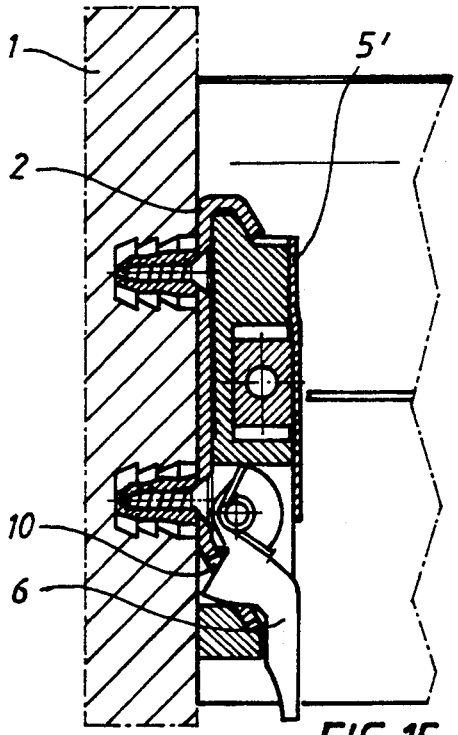
FIG. 15: A snap-on hanger with the front panel in released position of the catch nozzle.

It is evident in FIG. 14 that the notch (1 0) of the snap-on hanger (2) reaches in the boom swing of the catch nozzle of the pawl; whereby, according to FIG. 15, the catch nozzle releases in the notch (10) of a snap-on hinge. Simultaneously, it is represented in FIGS. 12 through 15, that a glide profile of the upper side of the snap-on hanger 2 is admitted into the upper half of the catch trigger (6').

The snap-on hanger (2) can be laterally adjusted on the glide profile; whereby, the catch nozzle of the pawl (6') further engages the wide embodied notch (10), and thereby, the side adjustment results with an installation of the catch nozzle in the notch (10). In FIGS. 12 through 15, a height and side adjustment is represented in the center of an eccentric; whereby, this eccentric engages an adjustable component and thereby, the eccentric is additionally directed. A lateral adjustment can also be undertaken, when this is laterally shifted and released.

The release system with the adjustment over the eccentric has furthermore the advantage, that the catch trigger (6'), as well as, the glide plane along with the lateral adjustment on the upper part of the snap-on hangers (2) remains largely hidden.

What is claimed is:

1. An adjustable front panel snap-on mechanism for a drawer having two concealed drawer sides comprising: snap-on hangers affixed to the front panel; an adjustment part secured to each of the snap-on hangers; a glide profile secured to each of the concealed drawer sides and adjustably affixed to each of the adjustment parts; means adjustably affixing each glide profile to each adjustment part to enable vertical positioning of the front panel with respect to the drawer sides; and pawl means secured to each adjustment part and operable with the snap-on hangers to enable horizontal adjustment between the front panel and the drawer sides and to secure the snap-on hangers to the front panel.

2. The mechanism as claimed in claim 1 wherein the adjustably affixing means includes an elongated hole in the glide profile, a cooperating aperture in the adjustment part, and an adjustment screw and bolt joining the glide profile to the adjustment part through the elongated hole and cooperating aperture.

3. The mechanism as claimed in claim 2 wherein the pawl means includes a pawl pivotally secured to the adjustment part including a catch nozzle, and a catch notch in the snap-on hanger having a width sufficient to enable horizontal movement of the catch nozzle with respect thereto.

4. The mechanism as claimed in claim 3 wherein the snap-on hangers are affixed to the front panel by screws and each of the snap-on hangers have a hook shaped to engage and secure an adjustment part to form a horizontal sliding plane.

* * * * *